US005601331A

United States Patent [19]

Austin, Jr. et al.

[11] Patent Number: 5,601,331

[45] Date of Patent: Feb. 11, 1997

[54] INTEGRATED DENTAL CHAIR AND POST-MOUNTED DELIVERY SYSTEM

[75] Inventors: George K. Austin, Jr., Newberg; William F. Fisher, Oregon City, both of Oreg.

[73] Assignee: A-Dec, Inc., Newberg, Oreg.

[21] Appl. No.: 418,244

[22] Filed: Apr. 6, 1995

[51] Int. Cl.[6] ..... A61G 15/14

[52] U.S. Cl. ..... 297/170; 433/79; 297/188.21; 297/173; 297/240

[58] Field of Search ..... 297/141, 142, 297/170, 173, 188.01, 188.21, 240, 241; 433/77, 79

[56] References Cited

U.S. PATENT DOCUMENTS

| | | | |
|---|---|---|---|
| 1,322,551 | 11/1919 | Efaw | 297/241 |
| 1,352,409 | 9/1920 | Hoefener | 297/241 |
| 2,595,921 | 5/1952 | Butz | 297/234 |
| 3,073,648 | 1/1963 | Johnson | 297/142 |
| 3,771,226 | 11/1973 | Lieb et al. . | |
| 3,813,147 | 5/1974 | Rick . | |
| 4,114,274 | 9/1978 | Jones . | |
| 4,500,134 | 2/1985 | Kaneko et al. | 297/173 X |
| 5,348,472 | 9/1994 | Joeckel et al. . | |

FOREIGN PATENT DOCUMENTS

| | | | |
|---|---|---|---|
| 686720 | 7/1930 | France | 297/240 |
| 1086136 | 2/1955 | France | 297/241 |
| 2315585 | 10/1973 | Germany | 297/188.21 |
| 2426291 | 1/1975 | Germany | 433/77 |

*Primary Examiner*—Peter R. Brown

*Attorney, Agent, or Firm*— Klarquist Sparkman Campbell Leigh & Whinston, LLP

[57] ABSTRACT

Clearance in the seat base to which a post is pivotally mounted provides for wide-angle rotation of post-mounted equipment that is supported by the post that is mounted to the base. The location of the pivot axis is such that the mechanisms employed for pivotally mounting the equipment to a dental chair do not protrude from the back of the chair.

12 Claims, 1 Drawing Sheet

INTEGRATED DENTAL CHAIR AND POST-MOUNTED DELIVERY SYSTEM

TECHNICAL FIELD

This invention relates to a dental chair system and more particularly to a dental chair with integrated post-mounted equipment.

BACKGROUND INFORMATION AND SUMMARY OF THE INVENTION

Dental chairs may have mounted directly to them the equipment or delivery systems that are used by the dentist for carrying out dental procedures. Preferably, such equipment is mounted to the chair in a fashion such that it is positionable on either side of the dental chair.

An important design consideration in mounting equipment to a dental chair is to avoid the need for mounting mechanisms that may protrude from the chair and thereby impede the dentist's or assistant's movement around the chair.

Another design consideration for such integrated systems is to permit the post that carries the dental equipment to be swung about a wide angle so that the equipment may be made available on either of opposing sides of the chair.

This invention is directed to a dental chair that has mounted to it a support post assembly that may be pivotally moved through a wide angle of at least 70°, thereby to permit the equipment carried by the support post assembly to be located on either of the two sides of the chair, or anywhere in between. The pivot axis and associated mechanisms for pivotally mounting the post to the chair are carried beneath the seat and, therefore, do not protrude outwardly therefrom. Moreover, sufficient clearance is provided for the pivotally-mounted end of the support post so that a relatively uncomplicated support mechanism (a rigid tube) may be pivotally mounted to the chair and swung through the entire wide angle without the need to incorporate in the post hinges or other mechanisms for accomplishing the full wide-angle motion.

DESCRIPTION OF PREFERRED EMBODIMENTS

Figure 2:
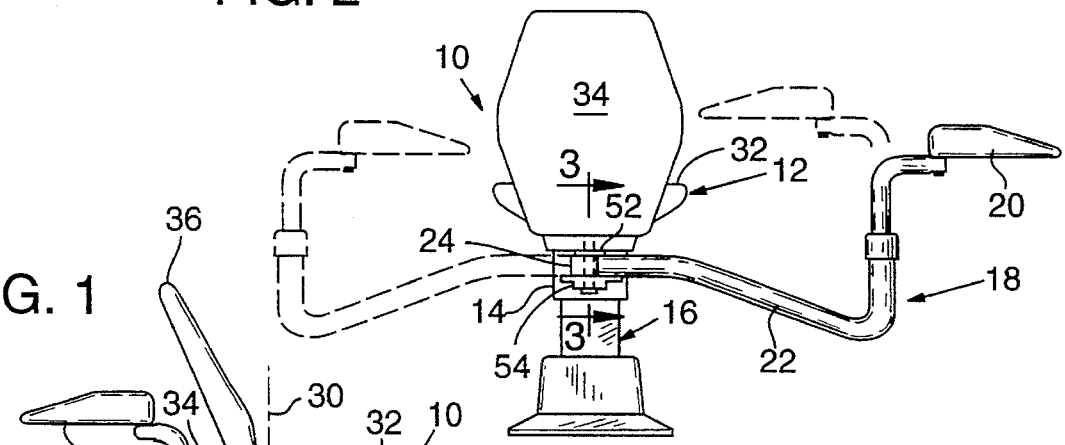
FIG. 2 is a back elevation view of the system of FIG. 1.
Figure 1:
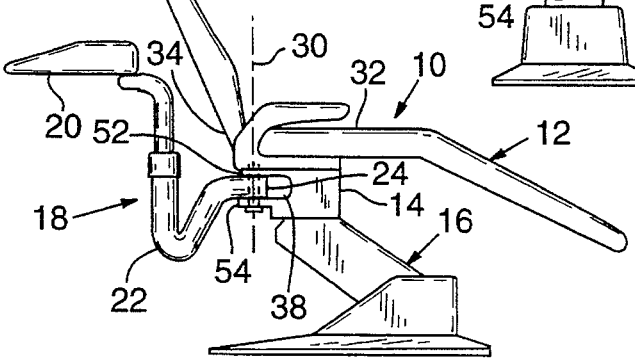
FIG. 1 is a diagram showing a side view of an integrated dental chair and post-mounted delivery system in accordance with the present invention.

Referring to FIG. 1, there is shown a side view of the integrated dental chair and post-mounted delivery system of the present invention. The system 10 includes a chair 12 that is carried on a seat base 14. The seat base is raised and lowered in a translational sense by a lift mechanism 16. Any of a number of lift mechanisms may be employed, such as disclosed in U.S. Pat. No. 5,267,788, hereby incorporated by reference.

A support post assembly 18 is pivotally attached to the seat base 14. The support post assembly may be employed, for example, for supporting a dental instrument control unit 20 within reach of the dentist or assistant.

In a preferred embodiment, the support post assembly includes a rigid, tubular part 22, the inner end 24 of which is pivotally attached to the seat base 14.

The seat base 14 and associated mechanisms for pivotal mounting of the inner end 24 of the support part 22 is configured and arranged to provide a vertical pivot axis 30 about which the support part 22 pivots.

The pivot axis 30 is located beneath the seat 32 of the chair that is carried by the seat base 14, and on which the dental patient sits. Moreover, the pivot axis is located forward of (that is, to the right in FIG. 1) the back surface 34 of the backrest 36 of the chair. Accordingly, the pivot axis 30 and associated pivot mechanisms described below do not protrude from the rear of the chair.

Figure 4:
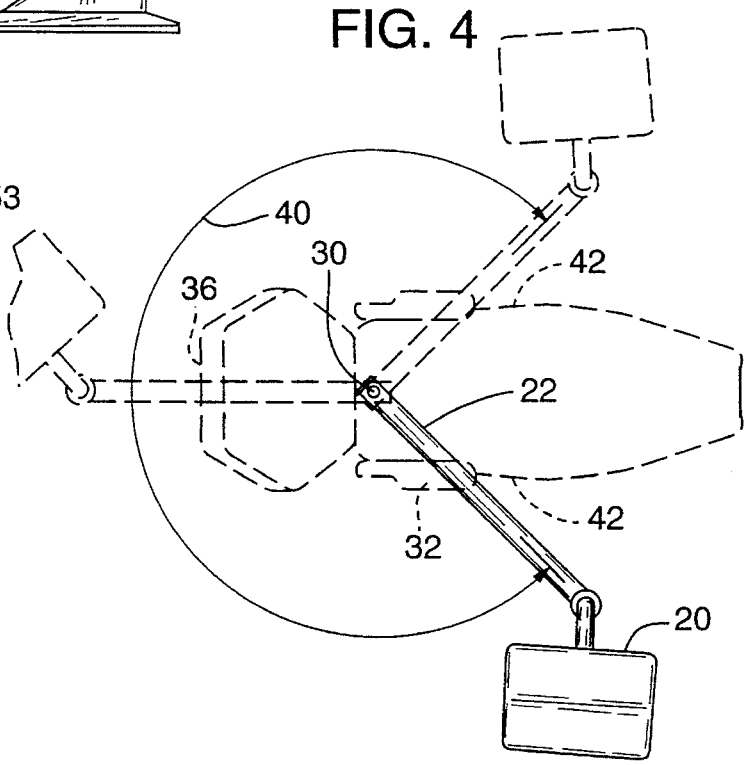
FIG. 4 is a diagram showing in top plan view the pivotal motion of the post-mounted delivery system.

The seat base 14 is formed with a clearance slot 38 sized to permit the inner end 24 of the post part 22 to pivot about the axis 30 through a very wide angle 40 (FIG. 4) of at least 270°. As best shown in FIG. 4, the clearance slot permits a piece of dental equipment, such as unit 20, to be located on either of opposing sides 42 of a dental chair by simply rotating the support assembly 18 from one side to another. It will be also appreciated that the support part 22, which comprises continuous rigid member (hence, having no incorporated mechanical or elastic hinges connected thereto), is able to pivot about the axis the full 270° angle. It will also be appreciated that when the support post assembly 18 is moved to a position on one side of the patient (such as shown in solid lines in FIG. 4, no portion of the support post 22 protrudes from the back 34 of the chair 12.

Figure 3:
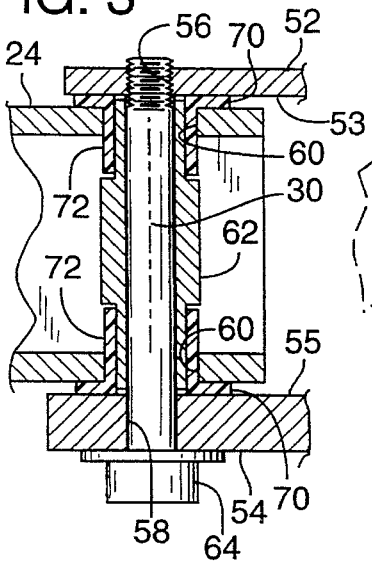
FIG. 3 is a cross-sectional view taken along line 3—3 in FIG. 2.

With reference to FIG. 3, the clearance slot 38 is defined in part by two brackets 52, 54 that are part of the seat base 14. The brackets are spaced apart, and permit the pivotal mounting of the inner end 24 of the support part 22. More particularly, top bracket 52 is a rigid flat plate having a threaded hole 56 formed therein and centered on the pivot axis 30. The lower bracket 54 extends in a parallel relationship with the top bracket 52. That bracket 54 includes an aperture 58 that is concentric with the hole 56 in the top bracket 52.

The inner end 24 of the tubular support part 22 has a through-hole 60 formed in it for concentric alignment with the hole 56 and aperture 58 of the top and bottom brackets respectively. A rigid hollow spacer 62 is located between the facing surfaces 53, 55 of the respective brackets 52 and 54. A threaded fastener 64 is passed through the aperture 58, spacer 62 and has its end threaded into the hole 56 of the top bracket 52.

The outside diameter of the inner end 24 of the support part 22 is slightly smaller than the space between the facing surfaces of the upper bracket 52 and lower bracket 54, thereby to accommodate the flanges 70 of bushings 72. One bushing is mounted to the reduced-diameter portion at each end of the spacer 62. The bushing may be formed of suitable material such as oil-impregnated bronze.

The spacer 62 length is less than the distance between the two surfaces 53, 55. Further, the height (measured vertically in FIG. 3) of the bushings 72 is such that the bushing may slide a short distance along the length of the spacer 62 as the brackets 52, 54 are drawn toward one another as described next.

The resistance to rotation of the part 22 about the pivot axis 30 may be varied by the user. To this end, the user may tighten the fastener 64 to draw the brackets 52, 54 toward one another, hence increasing the compressive force applied to the bushing flanges 70. The frictional resistance to rotation of the post 22 will increase accordingly.

It is contemplated that any of a number of mechanisms may be employed for pivotally mounting the support assembly 18 at the axis location 30 depicted in the figures. For example, a single bracket may be employed for mounting the support part 22.

Although the foregoing has been described in connection with preferred and alternative embodiments, it will be appreciated by one of ordinary skill in the art that various modifications may be substituted for the mechanisms and method described here without departing from the invention as defined by the appended claims and their equivalents.

The invention claimed is:

1. A dental chair system, comprising:

a seat base to which a seat of a dental chair may be fastened, the seat base defining a clearance slot therein beneath the seat, the seat base including a first bracket and a second bracket spaced apart from the first bracket;

a support post having one end pivotally mounted to the seat base within the slot at a vertical pivot axis and the support post being pivotable about the axis through an angle of at least 270°, the other end of the support post extending from the seat base and exposed for permitting dental equipment to be mounted thereto, the support post being pivotally mounted between the first and second brackets at the vertical pivot axis;

a hollow spacer mounted inside the post; and a threaded member extending through the first bracket, the spacer, and the post and threading into the second bracket thereby to provide the pivotal mounting of the post to the brackets, and in which threading the threaded member draws both the first bracket and second bracket closer together to increase the resistance to pivoting of the post.

2. The system of claim 1 wherein the end of the support post that is pivotally mounted to the seat base comprises a continuous rigid part that is pivotable about the axis through an angle of at least 270°.

3. The system of claim 1 further comprising a seat fastened to the seat base, wherein the pivot axis is beneath the seat.

4. The system of claim 3 wherein the seat includes a front and a back corresponding to the front and back of a dental patient that is seated in the chair and wherein the support post is pivotable about the axis into a position whereby no portion of the post protrudes from the back of the seat.

5. The system of claim 4 wherein the seat includes opposite sides and wherein the support post is pivotable about the axis between locations adjacent each of the opposing sides.

6. The system of claim 1 further comprising a lift mechanism to which the seat base is fastened, the lift mechanism operable for translationally raising and lowering the seat base and bracket to which the support post is mounted.

7. A dental chair system, comprising:

a seat;

a seat base mounted beneath the seat to carry the seat, the seat base having a pair of brackets protruding therefrom beneath and spaced apart to define a clearance space beneath the seat;

a support post having one end pivotally mounted to the brackets at a pivot axis that passes through the clearance space, the support post being pivotable about the axis through an angle of at least 270°;

a spacer mounted inside the post;

a threaded member extending through the spacer and the post and fastened to the brackets thereby to provide the pivotal mounting of the post to the brackets; and a bushing carried on the post and about which the post pivots, the bushing providing resistance as the post pivots.

8. The system of claim 7 further comprising a lift mechanism to which the seat base is fastened, the lift mechanism operable for translationally raising and lowering the seat base and bracket to which the support post is mounted.

9. The system of claim 7 wherein the support post includes a rigid part that is pivotable about the axis through an angle of at least 270°.

10. The system of claim 7 wherein the axis is a vertical one.

11. The system of claim 9 wherein the bushing and threaded member are arranged such that the resistance provided by the bushing can be varied by threading the threaded member.

12. The system of claim 9 wherein the pair of brackets are integral with the seat base.

* * * * *

UNITED STATES PATENT AND TRADEMARK OFFICE

CERTIFICATE OF CORRECTION

PATENT NO. : 5,601,331

DATED : February 11, 1997

INVENTOR(S) : George K. Austin, Jr.

It is certified that error appears in the above-identified patent and that said Letters Patent is hereby corrected as shown below:

Column 1, line 31, "70°" should read --270°--.

Signed and Sealed this

Seventh Day of April, 1998

Bruce Lehman

*Attest:*

BRUCE LEHMAN

*Attesting Officer*

*Commissioner of Patents and Trademarks*